United States Patent [19]

Berry et al.

[11] 4,239,191

[45] Dec. 16, 1980

[54] APPARATUS FOR CONTROLLING COMBUSTION IN A METAL MELTING FURNACE

[75] Inventors: Milton E. Berry; Ronald L. Pariani, both of Carrollton, Ga.

[73] Assignee: Southwire Company, Carrollton, Ga.

[21] Appl. No.: 63,485

[22] Filed: Aug. 3, 1979

Related U.S. Application Data

[62] Division of Ser. No. 879,034, Feb. 21, 1978, Pat. No. 4,211,555.

[51] Int. Cl.[3] ..... C21D 11/00

[52] U.S. Cl. ..... 266/200

[58] Field of Search ..... 266/200, 87; 239/75, 239/132.3; 165/47, 107 R

[56] References Cited

U.S. PATENT DOCUMENTS 3,059,913 10/1962 Sands ..... 75/60

*Primary Examiner*—P. D. Rosenberg

*Attorney, Agent, or Firm*—Herbert M. Hanegan; Stanley L. Tate; Robert S. Linne

[57] ABSTRACT

Disclosed is apparatus for treating the components of a gaseous fuel mixture, to obtain a predetermined mass ratio of the gaseous components, for use in a metallurgical melting furnace. Two streams of gaseous fuel components are temperature equalized in a heat exchanger, pressure equalized by pressure balancing regulators, and mixed together by a mixing valve which controls only the volume flow rates of the two streams. The resulting gaseous fuel mixture has a predetermined oxygen to fuel mass ratio, which is easily maintained near stoichiometric composition and which when combusted, supplies a hot gaseous blast of predetermined composition. When air and a liquified fuel such as liquid propane are the fuel components, the liquified fuel is vaporized and optionally diluted with dry air prior to heat equalizing, pressure equalizing, and mixing. When a gaseous fuel such as natural gas is one of the fuel components, no vaporization or dilution is required. The resulting carefully controlled gaseous fuel mixture is used to provide both the heat and the required atmosphere of controlled chemical composition in a copper melting furnace.

9 Claims, 2 Drawing Figures

APPARATUS FOR CONTROLLING COMBUSTION IN A METAL MELTING FURNACE

This application is a division of our copending application Ser. No. 879,034 filed Feb. 21, 1978, now U.S. Pat. No. 4,211,555.

BACKGROUND OF THE INVENTION

This invention relates to metallurgical melting processes and more particularly to a method of and apparatus for accurately regulating the gaseous fuel-air mixture employed for providing heat and for providing a proper atmosphere for a copper melting furnace.

Many metallurgical processes are carried out in an environment characterized by high temperatures and a gaseous atmosphere of closely controlled chemical composition. An example of one such process is that carried out in a copper melting furnace. Other examples are heat treating furnaces or surface treatment furnaces such as carburizing ovens in which close atmosphere control is required. To achieve this controlled atmosphere, many prior art processes use electric heaters to provide primary heating and a separate combustion gaseous fuel supply to provide an atmosphere of controlled chemical composition. A more advantageous way to carry out these processes is to provide a single source of hydrocarbon fuel, e.g., natural gas or methane, propane, butane or the like which, upon combustion, with air or oxygen supplies both the required heat and an atmosphere having the required chemical composition. However, many problems arise when adapting a combustion system to fulfill two diverse objectives. One major problem is accurate control of the chemical composition of the mixture which is to be combusted. This is most important because this initial composition has the greatest effect on the combustion process and once this initial composition is known or fixed, the resulting products of the combustion process can be accurately predicted.

It is especially troublesome to maintain accurate control of the fuel and air mixing over a wide range of varying flow rates which are often required due to the varying heat demands of some metallurgical processes, e.g., the melting of copper to supply a variable rate casting process.

The ratio of air to fuel influences both the combustion temperature and the composition of the products of combustion. If the mixture contains excess air, the flame is relatively cool and the products of combustion contain unreacted oxygen. If the mixture contains excess fuel the flame is much hotter and the products of combustion contain unreacted hydrogen.

More precisely, it is the mass ratio of fuel to available oxygen in the air which most influences the combustion process. However there are other variables, such as the temperature and humidity and density of the air which also have a secondary influence on the combustion process as explained in detail hereinafter.

For example, the temperature of the ambient air used as a source of oxygen may vary as much as 40° F. during any given day, causing about a 3.5% change in the mass flow of oxygen at a constant volume flow of air thus changing the composition of the combustion gases. Such a variation has a significant effect on the atmosphere generated by combustion in a metallurgical melting furnace and can adversely affect the quality of the product produced. Similarly, variations in the humidity of the ambient air can have a significant effect on the oxygen content of a given volume of air, particularly at high temperatures. Thus, for example, at 110° F., a variation in humidity from 0% to 100% of the ambient air causes a reduction of the oxygen content of the air of about 7%. This reduction of oxygen content can have a significant and deleterious effect on many metallurgical processes. However, more importantly, changes in humidity of the incoming air stream have a pronounced effect on the chemical composition of the combustion gases due to the equilibrium reactions of the combustion process. For example, a high level of water vapor in the reactant stream causes an increase in the water vapor level of the product stream which inhibits complete combustion due to the well known chemical rules.

Conventional systems generally mix fuel and air on a volume flow basis and therefore do not supply a constant stoichiometric mass ratio of fuel to oxygen under varying operating conditions. One such mixing device is disclosed in U.S. Pat. No. 3,799,195.

Other patents which have been uncovered relating to combustion gas mixing devices are as follows:

U.S. Pat. No. 3,883,322
U.S. Pat. No. 3,934,987
U.S. Pat. No. 3,788,825
U.S. Pat. No. 3,230,059
U.S. Pat. No. 3,721,253

These patents are generally concerned with vaporizing and/or mixing one or more gaseous hydrocarbons for combustion but are not addressed to the problems associated with regulating the mass flow of combustible gases to provide both heat and a precise nonoxidizing atmosphere in a metallurgical process, e.g., copper melting furnace.

In melting copper, care must be taken to limit the oxygen content added to the melted copper to as low a value as possible, preferably zero. In practice, however, this goal is difficult to attain due to the normal variations of the furnace atmosphere generated during the combustion process. Although it is generally desirable to limit the oxygen content to below about 0.045% (by weight), at varying times this limit can be exceeded. If the oxygen content of the metal exceeds about 0.05% the copper is brittle and must be remelted and/or deoxidized to reduce the oxygen content. In practice an oxygen content of about 0.03% or less is preferred.

In U.S. Pat. No. 3,199,977 there is disclosed one type of copper melting furnace which employs a combustion system designed to operate on natural gas so as to yield cast copper bar with an oxygen content of from 0.01 to 0.035%. The patentees recognize that inadequate fuel-air mixing can result in cast bars with greater than desired oxygen levels. However, in this patent the desired mixing control is accomplished by providing an off-centered orifice plate upstream of a mixing elbow which directs air into the fuel system in predetermined way which is empiracally derived. This patent does not recognize, nor does it deal with variations in fuel-air mass flow ratios resulting from pressure-temperature fluctuations in one or both of the gaseous components used in the combustion process and thus the apparatus described in the patent must be constantly monitored and adjusted. In addition, since an adequate supply of natural gas is not always available, it would be desirable to operate a combustion system on liquified gas. However difficult problems arise when attempting to accurately control combustion by mixing air with fuel on a volume basis. It is known that variations in the temperature or pressure of a gas will change the mass per unit volume but it is not practical to maintain all the variables at a constant value due to the very large volumes and high flow rates involved.

SUMMARY AND OBJECTS OF THE INVENTION

Broadly, the invention relates to a method of controlling combustion in a melting furnace and apparatus for providing a gaseous fuel mixture to a melting furnace which has a predetermined mass ratio of its gaseous fuel and oxygen components. The method comprises temperature and pressure equalization steps of the two gaseous streams prior to mixing the streams in a mixing device of the type which controls the volume flow rate of the two gaseous streams therethrough then combusting the mixture to provide a hot gaseous blast of known chemical composition. Temperature equalization is accomplished by passing the two streams in heat exchange relationship to each other. Pressure equalization is accomplished by reducing the pressure of the higher pressure stream to that of the lower pressure stream.

When a liquefied fuel, such as liquid propane, is employed as the fuel, it is vaporized prior to temperature and pressure equalization.

When ambient air is employed to dilute the vaporized liquid fuel so as to have about the same physical characteristics as natural gas, the additional step of drying the air to a predetermined low humidity is preferably carried out prior to temperature and pressure equalization.

The resultant gaseous fuel mixture is then supplied to the metallurgical process, such as a copper melting furnace, under carefully regulated conditions which yield predictable products of combustion. In the case of copper melting, the resulting cast copper may have an oxygen content which is consistently within the acceptable limit of less than about 0.03%.

Accordingly, it is an object of the invention to provide a combustible gas mixture having a regulatable, predetermined air to fuel mass flow ratio.

Another object of the invention is to provide a furnace combustion system which yields the required heat and products of combustion with economy, efficiency and consistency.

A further object of the present invention is to provide a fuel-air mixture system which compensates for variations in the physical properties of the gaseous fuel air mixture prior to burning in a metallurgical process.

Still another object of the present invention is to provide a compensated gaseous fuel-air mixture as aforementioned for use in a copper melting furnace.

A still further object of the present invention is to provide a method and means for compensating for variations in the temperature, pressure and humidity of ambient air supplied to a gaseous fuel mixture used in a metallurgical heat treating process.

Yet another object of the present invention is to easily and consistently regulate the atmosphere of a copper melting furnace to the reducing side whereby low level oxygen content on the order of 0.035% or less in the cast bar is attained.

Other objects and the many attendant advantages inherent in the invention will become apparent from a study of the accompanying description, claims and drawings.

DESCRIPTION OF THE PREFERRED EMBODIMENT

The present invention is most useful whenever it is necessary to combust fuels obtained from liquified hydrocarbons such as propane or butane due to the unavailability of an adequate supply of natural gas.

Figure 1:
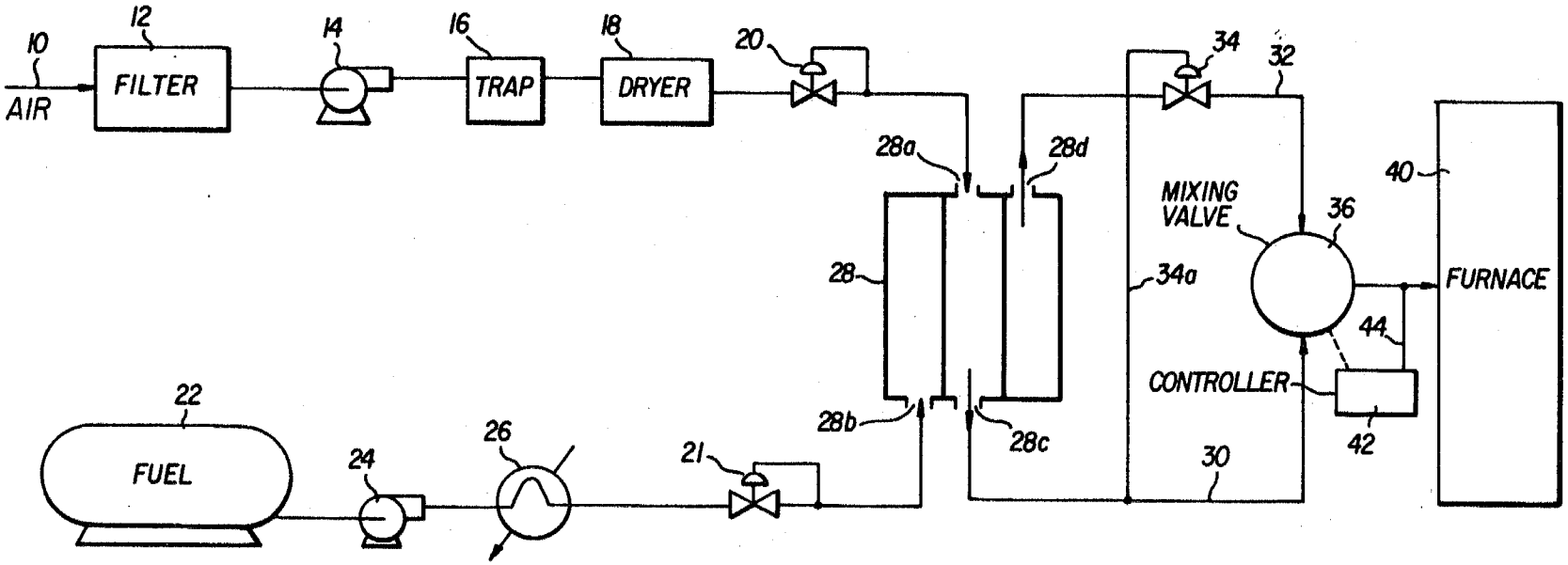
FIG. 1 is a schematic diagram illustrating embodiments of the present invention wherein a gaseous fuel and ambient air are separately treated and combined prior to introduction to a metallurgical melting furnace.

Referring now to FIG. 1, air intake 10 supplies air to filter 12 where the solid particulates are removed prior to entering compressor 14. The filtered air is compressed to a suitable pressure, e.g., about 5 psig and is directed through an oil and water trap 16 where excess moisture and oil vapor are condensed from the air. A dryer 18 may be provided to additionally remove any remaining moisture and oil vapors. Dryer 18 can be a refrigerated dryer, a regenerative dryer with absorbent, e.g., silica gel, or a combination of refrigerative and regenerative dryers. It is preferred that the moisture content of the air have a relatively low and consistent value to insure that the behavior of the subsequent combustion process is predictable.

Typically, dryer 18 delivers air with a dew point of between 0°–40° F. depending on the nature of the dryer. The pressure of the air stream leaving dryer 18 is controlled by a pressure regulator 20 of conventional design.

Where liquid fuel, such as liquid propane or butane, is used it is stored under pressure in a storage tank 22, typically at ambient temperature. The liquid fuel is pumped by pump 24 through vaporizer 26 to provide a gaseous fuel stream at about 6–9 psig which is controlled by pressure regulator 21, and at about 100° F. or whatever temperature is required for the particular fuel used. The hot gaseous fuel is directed into heat exchanger 28.

Heat exchanger 28 has inlets **28*a* and 28*b* and outlets 28*c* and 28*d* for the individual air and fuel streams, respectively. The gases are passed in indirect heat exchange relationship within each other where the respective temperatures are substantially equalized prior to mixing. Heat exchanger 28** is designed such that the temperature difference (Δ) between the air stream and the fuel stream at the outlet is always less than about 10° and preferably less than 2° F. The exit temperatures of the air and fuel streams are always above the vaporization temperature of the particular fuel utilized and may increase or decrease together as ambient conditions vary.

The temperature equalized air and fuel streams separately enter mixing valve 36 via their respective conduits 30, 32. A regulator 34 is provided in conduit 32, to substantially equalize the pressure of the fuel stream with that of the air stream by means of a sensing line **34*a* which automatically controls the fuel downstream pressure. Thus, the temperature and pressure equalized air and fuel streams are separately delivered to a mixing valve 36**, which is preferably located near the metal melting furnace.

Mixing valve 36 is of a conventional design which only controls the desired volume ratio of the two gases being mixed prior to entering burners (not shown) associated with a metallurgical melting furnace 40. For example, mixing valve 36 may have an adjustable orifice plate (not shown) in the air stream inlet and another plate (not shown) in the fuel stream inlet. One suitable mixing valve is commercially available as the "Gas Blender Valve" manufactured by Selas Corporation of America, Dresher, Pa.

It will be recognized that each of the fuel and air streams are both temperature and pressure equalized before being mixed in the constant volume flow rate mixing valve 36. Thus, the fuel-air mixture produced has a predetermined and consistent fuel to oxygen mass ratio which yields predictable combustion products. In use, mixing valve 36 is set to provide a fuel-air mixture which may be of stoichiometric proportion, or otherwise, depending on the exact requirements of the metallurgical heat treating process being carried out. A fuel-gas mixture which yields a slightly reducing atmosphere is preferred for melting copper.

Where the furnace 40 is a copper melting furnace, such as the furnace described in previously mentioned U.S. Pat. No. 3,199,977, the fuel-air volume ratio is about 1 to 9.6, for natural gas, for less than complete combustion. Where propane is used about 1:25 volume ratio is necessary.

Another feature of the present invention is the use of a combustion analyser 42 to automatically (or manually) control the fuel-air ratio. A continuous sample of gas to be analysed is taken from the mixture leaving the mixing valve 36 and fed into the analyzer 42 via conduit 44 where it is burned in a thermally balanced combustion chamber. One such analyser is the "Qual-O-Rimeter" (a trademarked product of Selas Corporation of America, Dresher, Pa.), which senses temperature changes of the burning gas. Since the temperature of the sample flame is affected by inter alia, fuel-air volume ratio, this analyser provides a basis for self-regulation of the mixing valve 36 automatically in response to the results of the analyser. Other types of combustion analysers which sense flame temperature, or products of combustion, using infra-red, thermal conductivity or flame ionization principles can also be used. For example, the oxygen content in the combustion gases could be analysed and the fuel-air ratio adjusted to insure a level below about 0.1%, or preferably less than 1000 parts per million.

DESCRIPTION OF ALTERNATE EMBODIMENT

Figure 2:
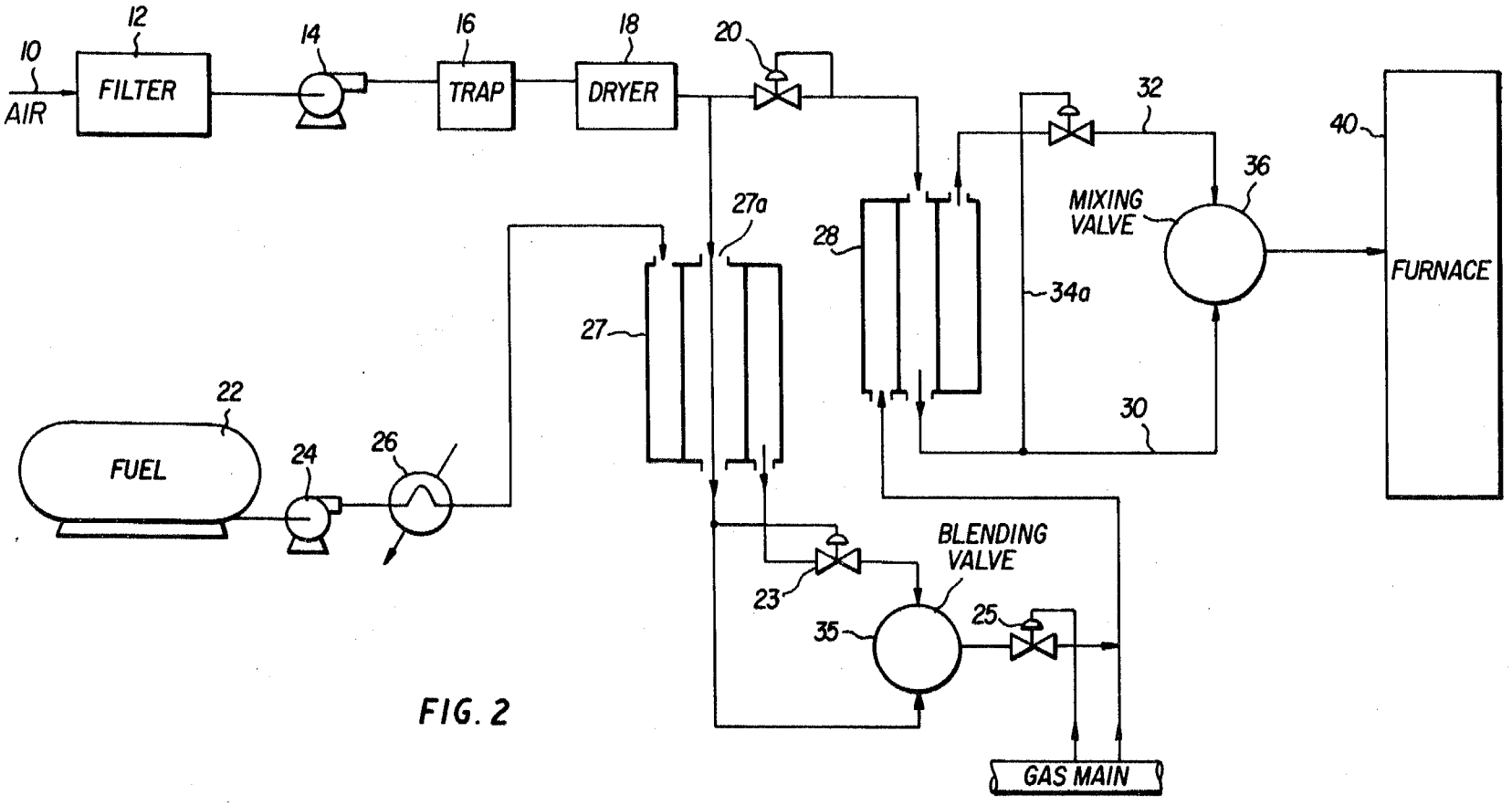
FIG. 2 is a schematic diagram illustrating embodiments of the present invention wherein a gaseous fuel and air are heated and premixed then combined with a natural gas stream prior to further treatment.

The present invention is also useful whenever there is at least some supply of natural gas. If the supply of natural gas is only temporarily, or seasonably, insufficient, then it is only necessary to disconnect or shut-off the source of natural gas entering heat exchanger **28*b* during the periods of insufficiency and switch back to use of the vaporized fuel. However, whenever the supply of natural gas is consistently insufficient to meet the volume requirements of the melting furnace, when it is possible to blend the vaporized fuel with some natural gas provided that the vaporized fuel is blended and diluted with an appropriate amount of air so as to have the same properties as an equal volume of natural gas. In order that the necessary blending and diluting is accomplished in a consistent and predictable manner, the principles of the present invention are applied as illustrated in FIG. 2** and described hereinafter.

The combustion air travels through the system in the same manner as described in FIG. 1. However, since it is also necessary to supply dilution air to the vaporized fuel stream prior to blending with natural gas, it is advantageous to bleed a small amount of combustion air (e.g., about 10%) from the output of dryer 18 into heat exchanger 27. Of course, it would be possible to supply dilution air from an entirely separate source if desired. Heat exchanger 27 is similar to heat exchanger 28, except for being of smaller size, and is used to substantially equalize the temperature of the dilution air stream and the vaporized fuel stream supplied by vaporizer 26.

The temperature equalized air and fuel streams are pressure equalized by regulator 23 prior to blending in mixing valve 35, which is similar to mixing valve 36 except for being of smaller capacity. The resulting blend of dilution air and vaporized fuel is adjusted to have the same pressure as the natural gas supply by regulator 25, then introduced into the natural gas line when desired.

From the foregoing embodiments it should be clear that the present invention satisfies a long-standing need to provide furnace atmospheres with pre-mixed combustible gases which yield predictable and constant products of combustion.

By separately treating the oxygen containing gas and the hydrocarbon containing gas streams prior to mixing to substantially equalize temperatures, pressures and moisture content, the variables which can cause significant fluctuations in the physical properties of the gases are eliminated so that a constant mass ratio is obtained at any given volume ratio setting of the mixing valve.

Although only preferred embodiments are specifically illustrated and described herein, it will be understood that many modifications and variations of the present invention are possible in light of the above teachings and within the purview of the appended claims without departing from the spirit and intended scope of the invention.

What is claimed:

1. Apparatus for separately treating the components of a gaseous fuel mixture prior to their mixing for use in a metallurgical melting furnace to yield a gaseous mixture having a predetermined and constant mass ratio of its component gases, comprising:

means for supplying a first gaseous fuel component having a characteristic temperature and pressure, said first component being an oxygen containing fluid;

means for supplying a second gaseous fuel component having a characteristic temperature and pressure, said second component being a hydrocarbon containing fluid;

means for substantially equalizing the temperatures of said first and second components without intermixing said components;

means for equalizing the pressures of said first and second components without intermixing said components; and means for mixing said first and second components in a predetermined volume ratio, whereby the resulting gaseous fuel mixture has a predetermined and constant mass ratio of said component gases due to their previously equalized temperature and pressure.

2. Apparatus as defined in claim 1 wherein said temperature equalizing means comprises heat exchanger means for exchanging heat between said first and second components without mixing them and so as to yield an outlet temperature of each component which is at least within 10° F. of each other.

3. Apparatus as defined in claim 1 wherein said pressure equalizing means comprises a pressure regulator in the supply means of the higher pressure component, having pressure sensing means, which communicates with the supply means of the one of said components having the lower pressure, for regulating the downstream pressure of said higher pressure component so as to provide the components at substantially the same pressure for subsequent mixing.

4. Apparatus as defined in claim 1 wherein said first component is air, further including means for drying said air to a constant, low moisture content, said drying means being located upstream of said temperature and pressure equalizing means.

5. Apparatus as defined in claim 1 wherein said second component is a liquefied fuel; further including means for vaporizing said liquefied fuel, said vaporizing means being located upstream of said temperature and pressure equalizing means.

6. Apparatus as defined in claim 1 further including means for burning said gaseous fuel mixture in a metallurgical furnace, means for analyzing the burning of said gaseous fuel mixture to determine any deviation from said predetermined mass ratio, and means for adjusting the volume mixing means to eliminate said deviation.

7. In a metallurgical melting furnace wherein a gaseous fuel mixture is combusted to yield both heat, for melting metal therein, and the required atmosphere, for protecting said metal, of the type including means for supplying a premixed gas fuel mixture to burner means from a mixing means for combining fuel and air on a volumetric basis while having a fuel-air volume ratio which is preselected to yield the proper furnace atmosphere, the improvement comprising:

heat exchanger means for substantially equalizing the temperature of the air and fuel components prior to mixing; and means for equalizing the pressure of said air and fuel components after equalizing their temperature but prior to mixing; whereby the resulting gaseous fuel mixture has a predetermined and constant mass ratio of its component gases when mixed on a volume basis.

8. The apparatus of claim 7 further including means for drying said air to a consistent, low moisture content, said drying means being located prior to said temperature and pressure equalizing means.

9. The apparatus of claim 7 further including means for vaporizing a liquefied fuel, said means being located prior to said temperature and pressure equalizing means.

* * * * *